United States Patent [19]

Kopachkov

[11] 4,068,614

[45] Jan. 17, 1978

[54] MACHINE FOR APPLYING LIQUID TO ABSORBENT MATERIAL

[75] Inventor: Slavco A. Kopachkov, Toronto, Canada

[73] Assignee: Rothmans of Pall Mall Canada Limited, Toronto, Canada

[21] Appl. No.: 684,196

[22] Filed: May 7, 1976

[51] Int. Cl.[2] ..... B05C 1/04

[52] U.S. Cl. ..... 118/6; 118/7; 118/210; 118/235; 118/325; 427/179

[58] Field of Search ..... 118/6, 7, 315, 323, 118/325, 235, 210, 241; 427/179, 424

[56] References Cited

U.S. PATENT DOCUMENTS

| | | | |
|---|---|---|---|
| 2,744,491 | 5/1956 | Vergobbi | 118/6 |
| 2,797,171 | 6/1957 | Fralish | 118/7 X |
| 3,603,283 | 9/1971 | Anderson et al. | 118/6 |
| 3,931,786 | 1/1976 | Teed | 118/235 |

*Primary Examiner*—Mervin Stein
*Attorney, Agent, or Firm*—Sim & McBurney

[57] ABSTRACT

Liquid is applied to absorbent material, preferably menthol solution to foil-backed paper for use in packaging menthol cigarettes, in uniform and controlled manner.

11 Claims, 7 Drawing Figures

FIG. 1
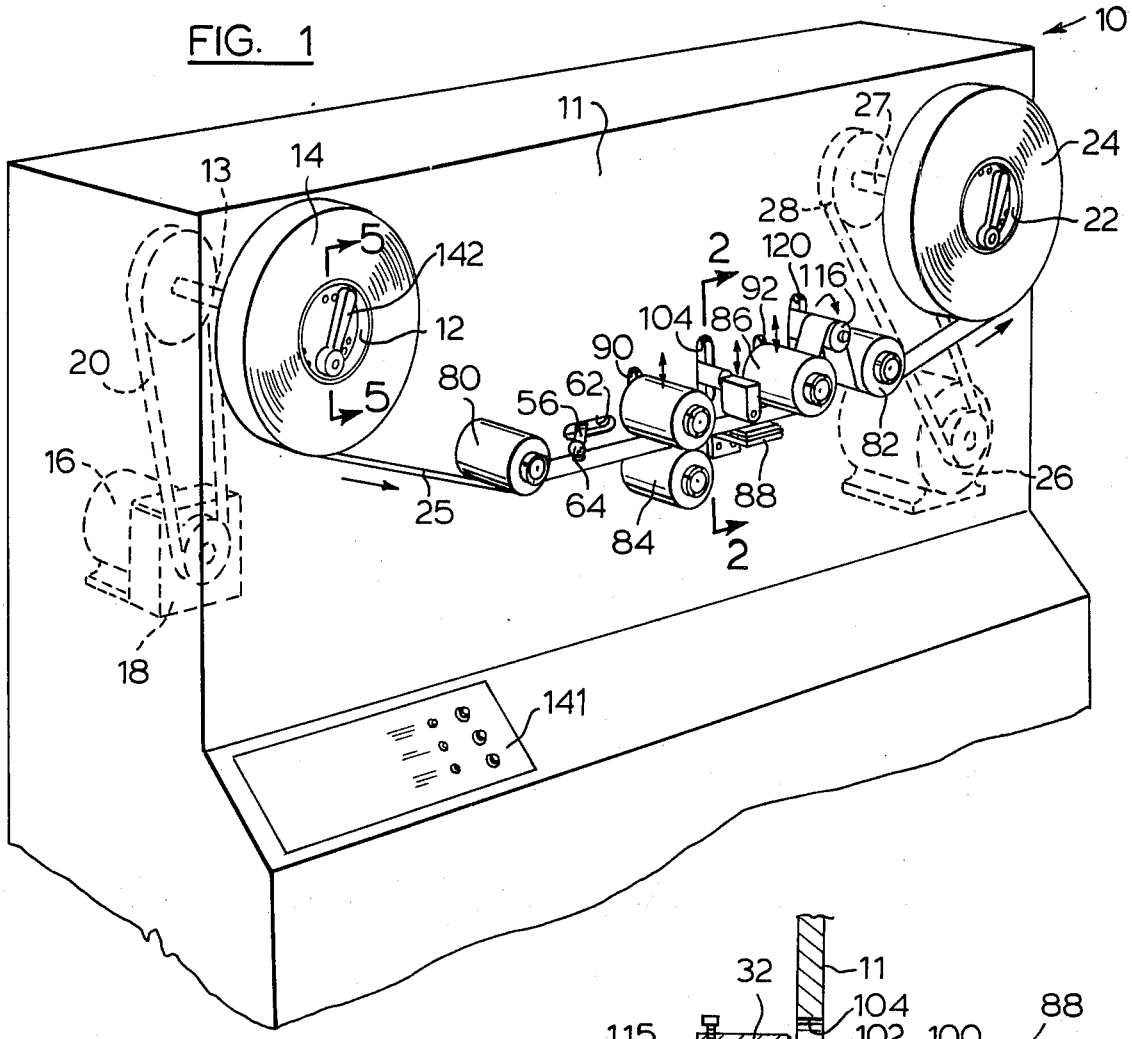
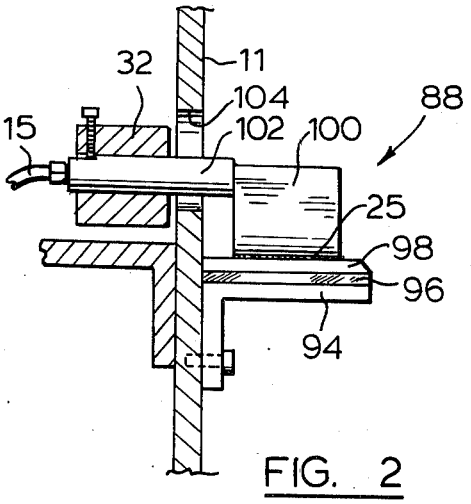
FIG. 2
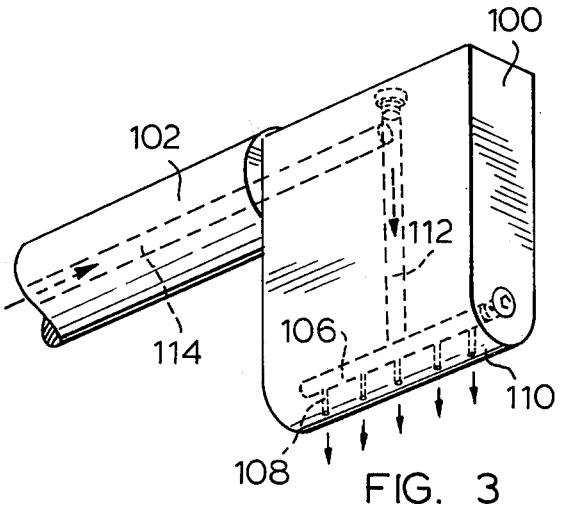
FIG. 3

MACHINE FOR APPLYING LIQUID TO ABSORBENT MATERIAL

FIELD OF INVENTION

This invention relates to a machine for applying liquid to a band of absorbent material, preferably for applying menthol to cigarette wrapping paper.

BACKGROUND TO THE INVENTION

Cigarettes are marketed in menthol and non-menthol flavors. The volatile nature of menthol tends to provide a "cool" taste to the tobacco smoke and is preferred by many smokers.

There are generally two procedures by which mentholation of cigarettes occurs. In the first procedure, menthol is positioned in the tobacco itself while, in the second procedure, the foil backed paper traditionally used to surround bundles of cigarettes in the package is impregnated with menthol, the menthol then permeating the tobacco by sublimation.

The second procedure is the one most widely used due to difficulties in controlling the direct addition of menthol to tobacco. However, the second procedure is not totally satisfactory since the current procedures used for impregnation of the foil-backed paper lead to inconsistent application of menthol and non-uniform concentration of menthol on the paper. There thus result inconsistent menthol concentrations in the cigarettes packaged using the menthol-impregnated foil-backed paper with consequential consumer dissatisfaction.

SUMMARY OF THE INVENTION

The present invention provides an apparatus for impregnation of foil-backed paper with menthol which results in the uniform application of menthol to the paper, hence overcoming the prior art difficulties mentioned above. In the present invention, menthol is applied to a band of foil-backed paper from a reel thereof continuously moving past an applicator and the application of the menthol is controlled at a uniform concentration.

While the apparatus of the invention is particularly useful in mentholating foil-backed paper and is described with particular reference thereto, the apparatus has a variety of other uses where it is desired to achieve a uniform application of a liquid to an absorbent material.

BRIEF DESCRIPTION OF DRAWINGS

FIG. 1 is a front elevational view of a mentholating machine in accordance with one embodiment of the invention;

FIG. 2 is a section taken on line 2—2 of FIG. 1;

FIG. 3 is a perspective close-up of a menthol-applying head used in the apparatus of FIG. 1;

DESCRIPTION OF PREFERRED EMBODIMENTS

Figure 5:
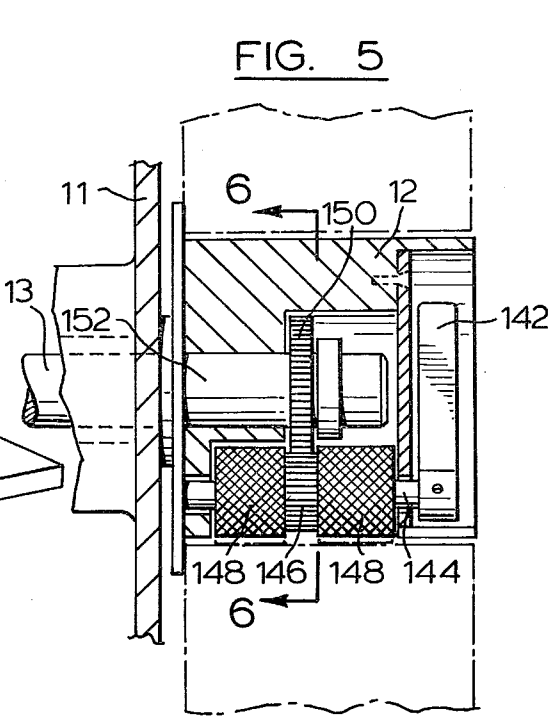
FIG. 5 is a sectional view taken on line 5—5 of FIG. 1.

Referring to the drawings, a mentholating machine 10 includes a box-like frame having an upright wall 11. A hub 12 is mounted on an axle 13 extending through the wall 11 and receives a spool 14 of foil-backed paper. The hub 12 and axle 13 is drivably connected to a generator-brake motor 16 through a reduction gear mechanism 18 and a belt connection 20.

A second hub 22 is provided for mounting a take-up spool 24 for take up of impregnated foil-backed paper, the paper passing as a continuous band 25 from the spool 14 to the take-up reel 24. The second hub 22 is drivably connected to a drive motor 26 by an axle 27 and a belt connection 28.

Vertically-spaced stationary frame members 29 and 30 are mounted to the inner surface of the upright wall 11 for supporting movable elements including a movable block element 32 which is mounted for vertical reciprocation on guide rods 34 and 36 extending between the stationary frame members 29 and 30.

Adjustable spacer elements 38 are mounted on the movable block element 32 to determine the limit of movement of the movable block element 32 towards the lower frame member 29.

Compression springs 40 are provided on the guide rods 34 and 36 and in compressive engagement with the block element 32 to provide spring-force induced downward movement of the block element 32.

Cam elements 42 and 44 each including a ramp surface are positioned on the lower frame member 29 at the longitudinal ends of the block element 32 for provision of a variable length of the cam elements under the block element 32. Wheels 46 and 48, constituting cam follower elements, are mounted at the ends of the block element 32 to engage the cam elements 42 and 44 respectively and ride up and down the ramp surfaces thereon.

Each of the cam elements 42 and 44 has an elongate recess 50 and 52 formed therein opening away from the block element 32 and a lever arm 54 and 56 respectively mounted in each of the recesses 50 and 52 for pivotal movement about vertical pivots 58 and 60 respectively.

The lever arm 56 extends forwardly from the pivot 60 through a horizontal elongate slot 62 in the front wall 11 of the machine 10 terminating in an actuation knob 64. The lever arm 56 extends rearwardly from the pivot 60 to termination at a pivotal connection 66 to a further lever arm 68 extending generally transversely of the lower frame member 29. The lever arm 56 also is pivoted to a fixed vertical pivot 70 mounted to the lower frame member 29.

The lever arm 54 has one end connected to the pivot 58 and the other end to another lever arm 72 at a vertical pivot 74. The lever arm 54 is pivoted to a fixed pivot 76 mounted to the lower frame member 29.

The lever arm 72 extends generally transversely of the lower frame member 29 and the ends of the lever arms 68 and 72 remote from the respective pivots 66 and 74 overlap and are pivotally connected to opposite ends of a lever arm 76 which itself is pivotally mounted to the frame member 29 at its midpoint to a vertical fixed pivot 78.

The various lever arms and pivots cooperate with the cams 42 and 44 to raise and lower the block member 32 upon horizontal movement of the actuation knob 64 relative to the wall 11. As the cams 42 and 44 are moved towards each other the wheels 46 and 48 ride up the ramps thereby raising the block member 32. As the cams 42 and 44 are moved away from each other, the wheels 46 and 48 run down the ramps under the influence of gravity and the springs 40 to restore the block member 32 to its original position.

Single guide rolls 80 and 82 are free-wheelingly rotatably mounted to the front face of the wall 11 for guiding the band 25 of foil-backed paper during its passage from the feed reel 14 to the take-up reel 24.

A pair of guide rolls 84 and a single guide roll 86 are located between the single guide rolls and serve to guide the band 25 of foil-backed paper as a smooth flat band over a menthol application device 88. Pressure in the nip between the pair of guide rolls 84 ensures a flat band surface entry to the application device 88.

The lower member of each of the pair of the guide rolls 84 is free-wheelingly rotatably mounted to the wall 11 with its axle extending through a bearing mounted to the undersurface of the lower stationary member 29 while the upper member of the pair of the guide roll 84 and the guide roll 86 are free-wheelingly rotatably mounted to the block member 32 by axles which pass through vertical slots 90 and 92 respectively formed in the machine face 11.

Raising the block 32 by actuation of the lever knob 64 thus releases the nip between the pair of rolls 84 and the tension in the band 25 which is necessary during start up or on breakage of the paper band 25.

The menthol applicator device 88 is shown in detail in FIGS. 2 and 3 and includes a stationary horizontal plate 94 affixed to the front wall 11 of the apparatus 10. Positioned on the plate 94 is a layer of resilient material 96 and a top layer of hard material 98 over which the paper band 25 moves.

A menthol application head 100 is mounted to the block member 32 by a spindle 102 passing through a vertical slot 104 in the wall 11, so that raising of the block 32 releases engagement of the head 100 from the layer 98 or the paper therebetween.

Internally of the head 100 is located a sparger pipe 106 which communicates with a series of ducts 108 to feed an alcoholic solution of menthol out of the lower rounded surface 10 of the head 100 onto the paper band 25 passing the head, typically as a series of parallel strips.

The sparger pipe 106 communicates with a vertical bore 112 in the head 100 which in turn communicates with a horizontal bore 114 passing axially of the spindle 102 to the opposite side of the block member 32. The bore 114 communicates with a menthol feed tube 115 which is connected to a source of menthol solution and a pump for pumping controlled quantities of menthol solution to the head 100.

An idler roll 116 is mounted between the single roll 86 and the single roll 82 to receive a loop of the band 25 of paper thereover. The idler roll 116 is connected at one end of an arm 118 through a vertical slot 120 in the wall 11. The arm 118 is pivotally mounted on the rear side of the wall 11 by a pivot 122.

A compression spring 126 is connected to the arm 118 at the roll 116 and to the movable block element 32 to provide spring resistance to downward movement of the roll 116 under tension applied by the loop of the material band 25.

The remote end of the arm 118 is connected to the actuator rod 128 of a linear variable displacement switch 130 mounted on the upper stationary frame member 30 and arranged to control tension in the paper band 25, as described below.

A disc 132 having circumferentially spaced apart openings 134 adjacent the rim is mounted on the axle of the lower of the pair of rolls 84. A photocell 136 is mounted to the lower stationary frame element 29 in alignment with the openings 134. The photocell 136 senses the speed of the openings 134. The photocell 136 senses the speed of rotation of the disc 132 and hence the linear speed of the paper band 25 as it passes between the nip between the pair of rolls 84 by the frequency of openings 134 passing the photocell 136.

The photocell 136 is electrically connected to the menthol feed pump for control of the pump speed and hence menthol solution flow rate in accordance with the sensed speed of the motor 16 as described in more detail below.

An up-down sensor 138 is mounted to the upper stationary frame element 30 and an actuation element 140 is mounted to the block member 32 for actuation of the sensor 138 when in the "up" position. The sensor 138 is connected to a visual representation display in a control panel 141 located at the front of the machine 10.

Figure 6:
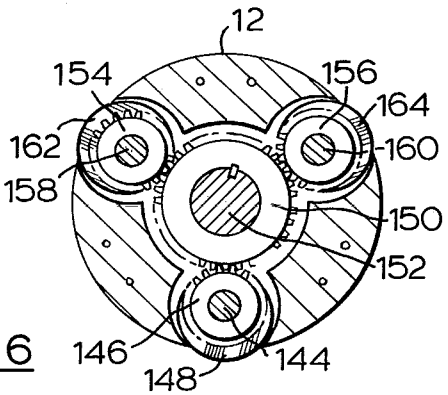
FIG. 6 is a sectional view taken on line 6—6 of FIG. 5.
Figure 4:
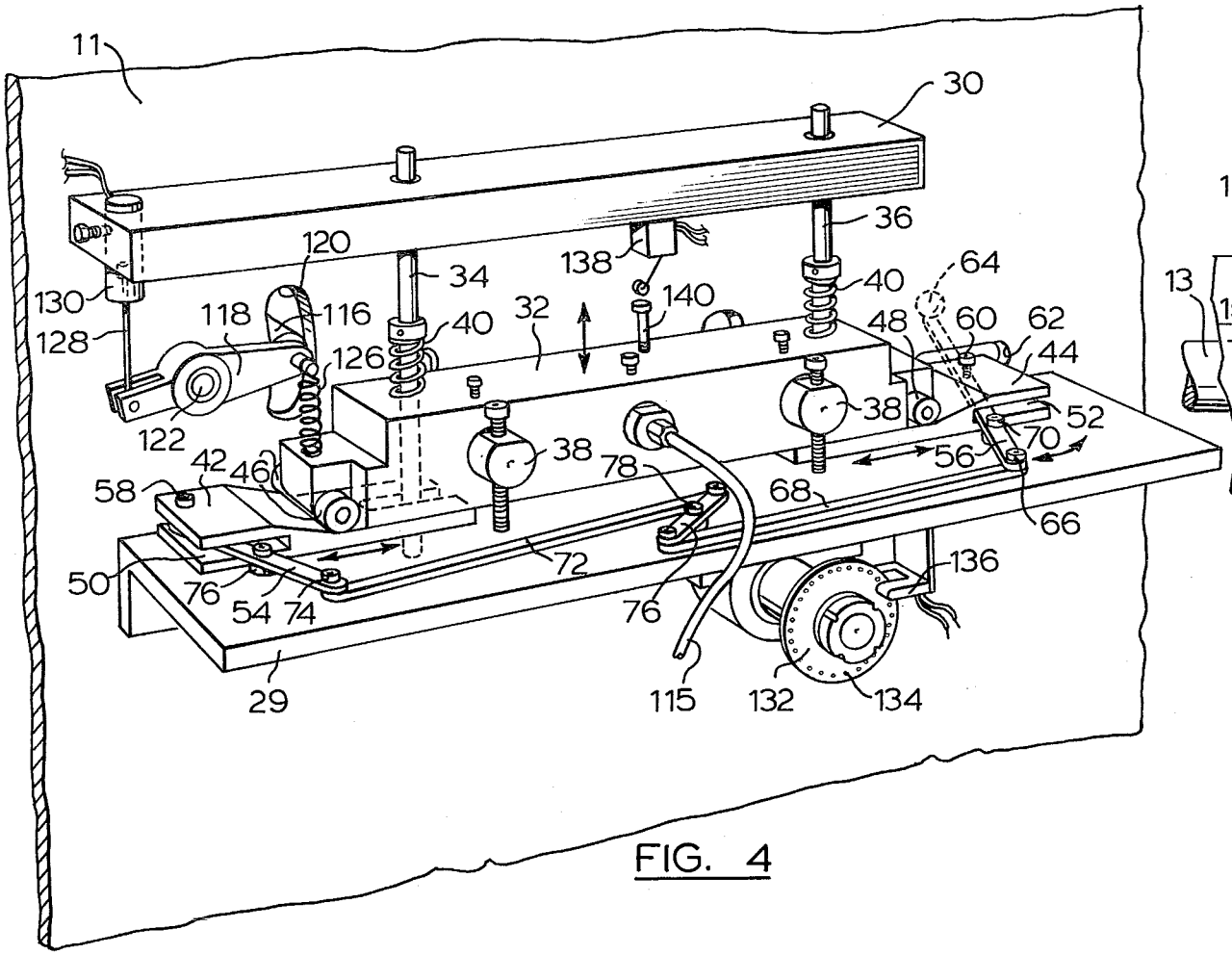
FIG. 4 is a rear view of the apparatus of FIG. 1.

Each of the hubs 12 and 22 is constructed as shown in detail in FIGS. 5 and 6 to provide a quickly-releasable but efficiently-lockable reel mounting system. This reel mounting system forms the subject of copending application Ser. No. 698,950 filed June 23, 1976.

A lever arm 142 actuates the mounting mechanism. The lever arm 142 is mounted at one end of a shaft 144 rotatably mounted in the hub 12. Also mounted to the shaft 144 is a gear wheel 146 and two eccentrically-mounted metal cylinders 148, one each axial side of the gear wheel 146. The gear wheel 146 meshes with a central sun gear wheel 150 mounted for rotation on a shaft 152 axially mounted in the hub 12.

Two planetary gear wheels 154 and 156 are also mounted in the hub 12 for rotation about shafts 158 and 160 respectively in meshing engagement with the sun gear wheel 150. In analogous manner to the eccentrically mounted metal cylinders 148, metal cylinders 162 and 164 are eccentrically mounted on shafts 158 and 160 respectively with one each axial side of the respective planetary gear wheels.

The eccentrically-mounted metal cylinders 148, 162 and 164 are arranged to project beyond the circumferential periphery of the hub 12 upon rotation of the respective shafts in one direction and to be located wholly within the circumferential periphery of the hub 12 when the respective shafts are rotated in the opposite direction.

Thus, by moving the lever arm 142 in one direction, the metal cylinders 148, 162 and 164 move outwardly to grip the inner surface of the reel mount and hold the reel to the hub, while subsequent moving of the lever arm 142 in the opposite direction releases the metal cylinders from the reel mount allowing ready removal of the reel from the hub.

The machine 10 is designed to provide a controlled application of menthol to a paper band to obtain a uniform application of menthol per unit length of paper. The actual quantity of menthol applied per unit length of paper band is controlled for the particular brand of cigarettes for which the paper is desired.

OPERATION

In operation, a full reel of foil-backed paper is locked to the hub 12 and, with the actuation knob 64 to the right as seen in FIG. 1 and hence with the block element 32 in its upper position, the free end of the paper is drawn beneath roll 80, between the pair of rolls 84, between the applicator head 100 and the plate 98, beneath roll 86, over roll 116, beneath roll 82 and onto an empty take-up reel locked to the hub 22, to establish a foil-backed paper movement path as shown in FIG. 1.

The lever knob 64 is moved to the left to lower the block element 32 and hence the upper of the pair of rolls 84, roll 86 and the applicator head 100 into contact with the paper band 25 and the motor 26 and menthol pump started up.

As the foil-backed paper is drawn past the applicator head 100, menthol solution is applied thereto in the required quantity to impregnate the paper band across the width thereof through the openings 108, typically as a series of strips in number equal to the number of said openings 108. In order to provide for the uniform application of menthol to the paper along the length thereof, the operation is controlled so that the same linear speed of the paper band past the applicator head 100 is maintained.

The linear speed of the paper band 25 past the applicator head 100 is directly proportional to the rotational speed of the disc 132. As seen in FIG. 1, the speed sensed by the photocell 136 is compared with a control speed and the output signal of the comparator is used to control the speed of the motor 26. As the diameter of the reeled-up paper on the hub 22 increases and hence there is a tendency for the linear speed of the band 25 to increase, the speed of the motor 26 slows down so that a constant linear speed of paper past the applicator head 100 is maintained.

The sensed rotational speed of the disc 132 also controls the operation of the menthol pump, in this case providing a menthol reference signal from the quantity selector which is fed to a comparator for comparison with the sensed speed of the pump to give the pump drive speed signal so that, in the event of a change of the power input, a consequential slow down or speed up of the speed of the paper band 25 is compensated for by a parallel slow down or speed up of the menthol solution pumping rate.

Figure 7:
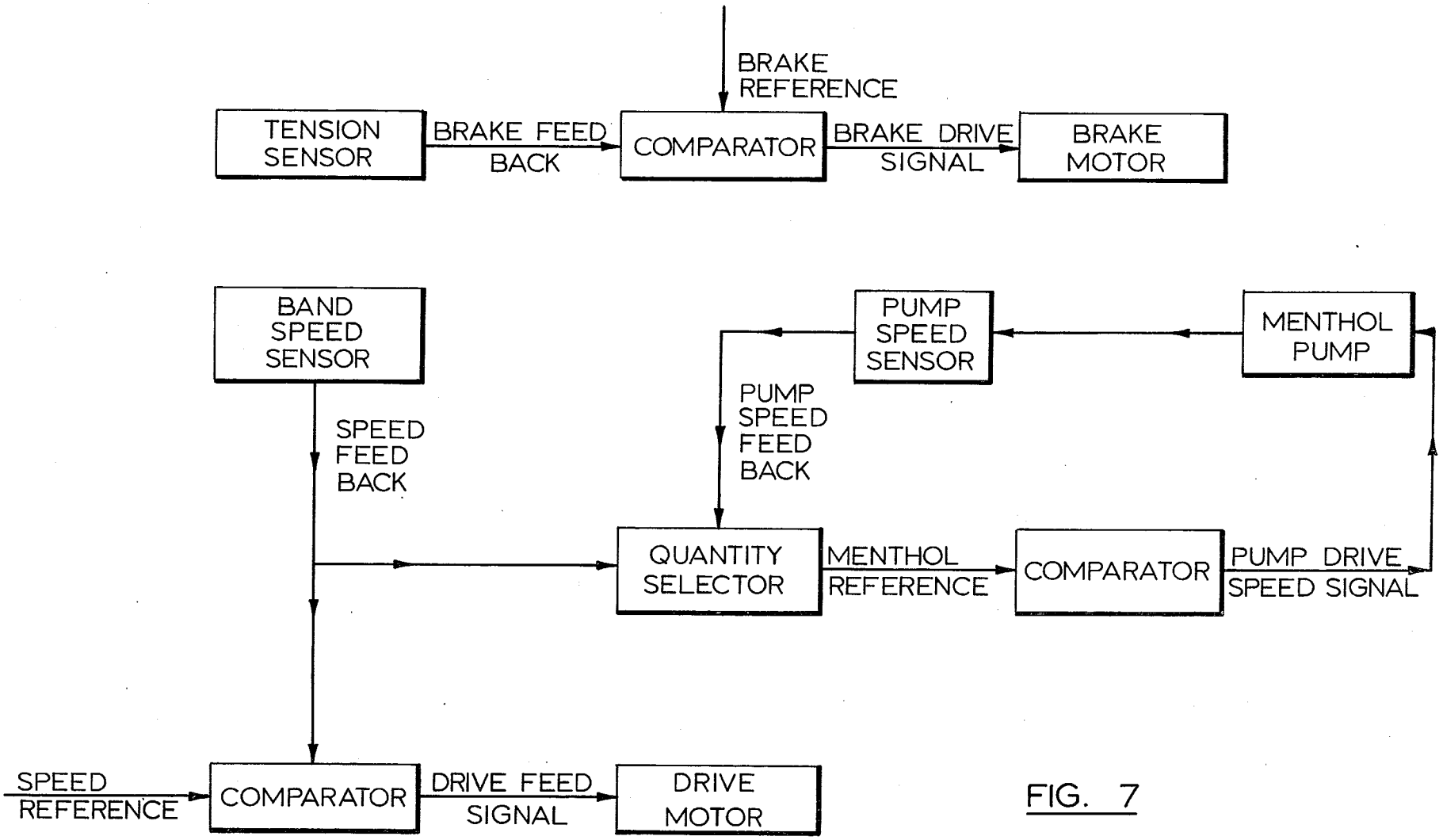
FIG. 7 is a schematic block diagram representation of the electronic controls on the operation of the mentholating machine of FIG. 1.

As seen in FIG. 7, as the diameter of the feed reel 14 decreases and hence there is a tendency for the tension in the paper band to decrease, the variable linear displacement switch 130 provides an output signal proportional to the vertical position of the roll 116 and hence the tension in the paper band 25. This output signal is compared in a comparator with a brake reference value which is pre-adjusted with a calibration weight. The generator 16 receives a signal which causes the brake motor to speed up or slow down in response to tension variations at the roll 116 to maintain a substantially constant tension throughout the operation. As the reel 14 of paper rotates, the generator 16 generates electrical power which is dissipated in a resistor. The action of electrical generator and dissipation acts as a brake on the reel 14, so that as the reel 14 decreases in diameter and hence the hub 12 rotates faster for the constant speed of the paper band 25 past the applicator head 100, more electricity is dissipated and the same braking force is applied so that a constant tension in the band 25 is maintained.

SUMMARY

The present invention therefore provides an impregnation procedure which has particular applicability for mentholating foil-backed paper for use in packaging of cigarettes. Modifications are possible within the scope of the invention.

What I claim is:

1. An apparatus comprising:

first hub means mounted for rotation about its axis and adapted to receive a take-up spool for a band of impregnated material;

drive motor means operatively connected to said first hub means for driven rotation of said first hub means on its axis;

second hub means spaced apart from said first hub means and mounted for rotation about its axis and adapted to receive a source spool of a band of material for impregnation;

brake motor means operatively connected to said second hub means for application of braking force to said second hub means;

said first and second hub means being mounted for rotation about parallel spaced upright axes on axles extending through an upright face of apparatus frame means;

band flow path defining means located between said first and second hub means for guiding said band of material for impregnation between said first and second hub means and comprising a plurality of roll means mounted for rotation about horizontal axes which are parallel to each other and to said axes of said axles of said first and second hub means;

said plurality of roll means including first and second spaced roll means mounted to said upright face at locations respectively adjacent said first and second hub means, a pair of upper and lower roll means, the lower of which is mounted to said upright face at a location closer to said first spaced roll means than to said second spaced roll means and the upper of which is vertically movable between a lower position defining a material band contacting position and an upper inoperative position, and a third roll means located closer to said second spaced roll means than said pair of roll means;

liquid applicator means located adjacent said band flow path for application of liquid material to said band of material; and control means associated with said drive motor means, brake motor means and liquid applicator means for controlling the application of liquid material to said band of material at a substantially uniform level.

2. The apparatus of claim 1, wherein said upright face is the outer face of a frame wall member, said frame wall member has a plurality of vertical parallel elongate slots therethrough, one of said elongate slots receiving an axle of the upper of said pair of rolls therethrough, another of said slots receiving an axle of said third roll means therethrough, support means positioned on the opposite side of said wall means from said upright face and supporting the free ends of said latter axles, upper and lower stationary flange members secured to said opposite side of said wall, vertical guide means extending vertically between said upper and lower flange members and mounting said support means for limited vertical movement, and actuation means associated with said support means for moving said support means between upper and lower vertical extremities of travel.

3. The apparatus of claim 2 wherein said liquid applicator means is located between said pair of roll means and said third roll means and comprises horizontally extending base means mounted to said front face, a liquid applicator head located above said base means and having a mounting arm extending through another of said vertical slots to mount said applicator head to said support means, a liquid flow path from a source of liquid material to the band-engaging surface of said head and pump means to pump said liquid material to said head at a predetermined flow rate.

4. The apparatus of claim 3 including fourth roll means located between said second and third roll means and extending through an arcuate slot in said wall means, lever arm means pivotally mounted to the inner face of said wall means and having the free end of said fourth roll means mounted to one end thereof, and spring means normally urging said fourth roll means upwardly whereby the tension in a band of material passing between said reels and over said fourth roll means acts in opposition to said spring means.

5. The apparatus of claim 4 wherein said spring means is a compression spring means mounted between said one end of said lever arm means and said support means.

6. The apparatus of claim 5, wherein said actuation means comprises first and second cam means positioned at opposite ends of said support means, cam follower means on said support means in engagement with said first and second cam means, said first and second cam means each including ramp means sloping upwardly and away from said opposite ends of said support means, and lever arm means for simultaneously moving said first and second cam means towards and away from each other, whereby said cam follower means at each end of said support means rides up and down the respective ramp means of said first and second cam means during said respective towards and away movement of said first and second cam means.

7. The apparatus of claim 6 wherein said simultaneous movement lever arm means comprises a first lever arm member pivotally mounted at one end in an elongate horizontal slot formed in one of said cam means, and at the other end to one end of a second lever arm member, said first lever arm member being pivotally mounted at its approximate mid-point to said lower stationary flange member, a third lever arm member pivotally mounted in an elongate horizontal slot formed in the other of said cam means and having an extension portion extending through a horizontal slot formed in said wall means and termination in an actuation knob, said third lever arm member being pivotally mounted at the end opposite to said actuation knob to one end of a fourth lever arm member and pivotally mounted to said lower stationary flange member intermediate said end pivotal connection and said slot pivotal connection thereof, said second and fourth lever arm members extending towards each other and overlapping at their respective opposite ends, and a fifth lever arm member pivotally connected at its ends to said opposite ends of said second and fourth lever arm members and pivotally mounted to said lower stationary member at the approximate mid-point of the length of said fifth lever arm member.

8. An apparatus comprising:

first hub means mounted for rotation about its axis and adapted to receive a take-up spool for a band of impregnated material;

drive motor means operatively connected to said first hub means for driven rotation of said hub means on its axis;

second hub means spaced apart from said first hub means and mounted for rotation about its axis and adapted to receive a source spool of a band of material for impregnation;

brake motor means operatively connected to said second hub means for application of braking force to said hub means;

band flow path defining means located between said first and second hub means for guiding said band of material for impregnation between said first and second hub means;

liquid applicator means located adjacent said band flow path for application of liquid material to said band of material; and control means associated with said drive motor means, brake motor means and liquid applicator means for controlling the application of liquid material to said band of material at a substantially uniform level;

said control means comprising speed sensing means associated with said band flow path defining means for sensing the linear speed of said material band through said flow path, liquid material pump control means operatively connected to said speed sensing means for controlling liquid flow to said applicator means in accordance with the speed sensed by said speed sensing means and in accordance with the desired level of application to said material band, drive motor control means operatively connected to said speed sensing means for maintaining said linear speed of said material band at a substantially constant value irrespective of the diameter of the reel of material taken up on said take-up spool, and brake motor control means for maintaining a substantially constant braking force on said material band irrespective of the diameter of the reel remaining on said feed spool.

9. The apparatus of claim 8, including tension sensing means associated with said band flow path defining means, and wherein said brake motor control means is operatively connected to said tension sensing means for maintaining the tension in said material band at a substantially constant level.

10. The apparatus of claim 8 wherein said first and second hub means are mounted for rotation about parallel spaced horizontal axes on axles extending through an upright face of apparatus frame means.

11. The apparatus of claim 10 wherein said band flow path defining means comprises a plurality of roll means mounted for rotation about horizontal axes which are parallel to each other and to said axes of said axles of said first and second hub means.

* * * * *